US006071155A

United States Patent [19]

Liang

[11] Patent Number: 6,071,155

[45] Date of Patent: Jun. 6, 2000

[54] ELECTRICAL WIRE MOUNTING STRUCTURE

[76] Inventor: Shih-Tsung Liang, No. 10, Lane 31, Ta-Feng Street, Lu-Chu Hsiang, Taoyuan County, Taiwan

[21] Appl. No.: 09/283,205

[22] Filed: Apr. 1, 1999

[51] Int. Cl.[7] ..... H01R 4/50

[52] U.S. Cl. ..... 439/805

[58] Field of Search ..... 439/805, 766, 439/784, 428, 429, 785, 801, 461, 462

[56] References Cited

U.S. PATENT DOCUMENTS 5,573,423 11/1996 Lin et al. ..... 439/462
5,899,777 5/1999 Liang ..... 439/805

*Primary Examiner*—Lincoln Donovan
*Assistant Examiner*—Chandrika Prasad
*Attorney, Agent, or Firm*—Rosenberg, Klein & Lee

[57] ABSTRACT

An electrical wire mounting structure, which includes a conductor member having a screw hole at one side and a tapered blind hole axially inwardly extended from the screw hole, an electrical wire installed in the tapered blind hole inside the screw hole at the conductor member, a binding member fastened to the conductor member to hold down the conductors of the electrical wire, the binding member having a tapered split base press-fitted into the tapered blind hole in the conductor member, a cylindrical coupling portion axially extended from the tapered base, and a center through hole which receives the electrical wire, and a screw member threaded into the screw hole at the conductor member to secure the binding member and the electrical wire in place.

6 Claims, 6 Drawing Sheets

ELECTRICAL WIRE MOUNTING STRUCTURE

BACKGROUND OF THE INVENTION

The present invention relates to an electrical wire mounting structure which comprises a conductor member, an electrical wire connected to the conductor member, a binding member forced to hold down the conductors of the electrical wire, and a screw member fastened to the conductor member to secure the binding member and the electrical wire in place.

FIGS. 8 and 9 show an electrical wire mounting structure according to the prior art. This electrical wire mounting structure comprises a metal mounting member 6 fastened to a conductor terminal at a storage battery (not shown), an electrical wire 4 connected to the metal mounting member 6, and a metal holding down screw 7 fastened to the metal mounting member 6 to secure the electrical wire 4 in place. The metal mounting member 6 comprises a threaded hole 61. The holding down screw 7 comprises an axial center through hole 72, and an outer thread 71. During installation, the conductors 41 of the electrical wire 4 are inserted through the axial center through hole 72 at the holding down screw 7 and then turned backwards and closely attached to the periphery of the holding down screw 7, then the holding down screw 7 is fastened to the metal mounting member 6 by threading the outer thread 71 of the holding down screw 7 into the threaded hole 61 at the metal mounting member 6. This electrical wire mounting arrangement has drawbacks. When the holding down screw 7 is fastened tight, the conductors 41 of the electrical wire 4 tend to be damaged or broken. Further, because the conductors 41 of the electrical wire 4 are not maintained in close contact with the inside wall of the holding down screw 7, electric conduction rate is low. FIGS. 10 and 11 illustrate another electrical wire mounting structure according to the prior art. This electric wire mounting structure comprises a metal mounting member 8 fastened to a conductor terminal at a storage battery, and an electrical wire 4 fastened to an the metal mounting member 8. The metal mounting member 8 comprises two parallel clamping arms at a front side, which are fastened up with a screw bolt when attached to a conductor terminal at the storage battery, an axially extended mounting hole 81 at a rear side, which receives the conductors of the electrical wire 4, and a transverse screw hole 82 perpendicularly extended from the axially extended mounting hole 81 to the periphery into which a screw rod 83 is threaded to hold down the conductors 41 of the electrical wire 4 in the axially extended mounting hole 81. This electrical wire mounting structure has numerous drawbacks as outlined hereinafter.

1. When the screw rod is threaded into the screw hole at the metal mounting member to hold down the conductors of the electrical wire, the conductors of the electrical wire tend to be damaged and broken, thereby causing an unstable electric conductivity.
2. When the conductors of the electrical wire is compressed and held down by the respective screw rod, the contact area between the conductors of the electrical wire and the periphery of the mounting hole is relatively reduced, thereby causing a resistance to be produced, and an electrical energy loss becomes inevitable when a resistance is produced.
3. The procedure of processing a screw hole at the metal mounting member is complicated. If the screw hole is not precisely processed, the conductors of the electrical wires cannot be positively secured in position by the screw rod, and the electrical wire will easily be pulled away from the metal mounting member.

SUMMARY OF THE INVENTION

The present invention has been accomplished to provide an electrical wire mounting structure which eliminates the aforesaid drawbacks. According to one aspect of the present invention, the electrical wire mounting structure comprises a conductor member having a screw hole at one side and a tapered blind hole axially inwardly extended from the screw hole, an electrical wire installed in the tapered blind hole inside the screw hole at the conductor member, a binding member fastened to the conductor member to hold down the conductors of the electrical wire, the binding member having a tapered split base press-fitted into the tapered blind hole in the conductor member, a cylindrical coupling portion axially extended from the tapered base, and a center through hole which receives the electrical wire, and a screw member threaded into the screw hole at the conductor member to secure the binding member and the electrical wire in place. The binding member can be rotated with the electrical wire relative to the screw member, therefore fastening up the screw member does not damage the conductors of the electrical wire. According to another aspect of the present invention, the conductor member comprises a conical projection axially disposed at an inner end of its tapered blind hole remote from the screw hole. When the electrical wire is installed, the conductors of the electrical wire are forced by the conical projection inside the conductor member to spread out, and to be evenly and firmly retained between the inside wall of the conductor member and the periphery of the conical projection for positive transmission of electricity.

DETAILED DESCRIPTION OF THE PREFERRED EMBODIMENT

Figure 1:
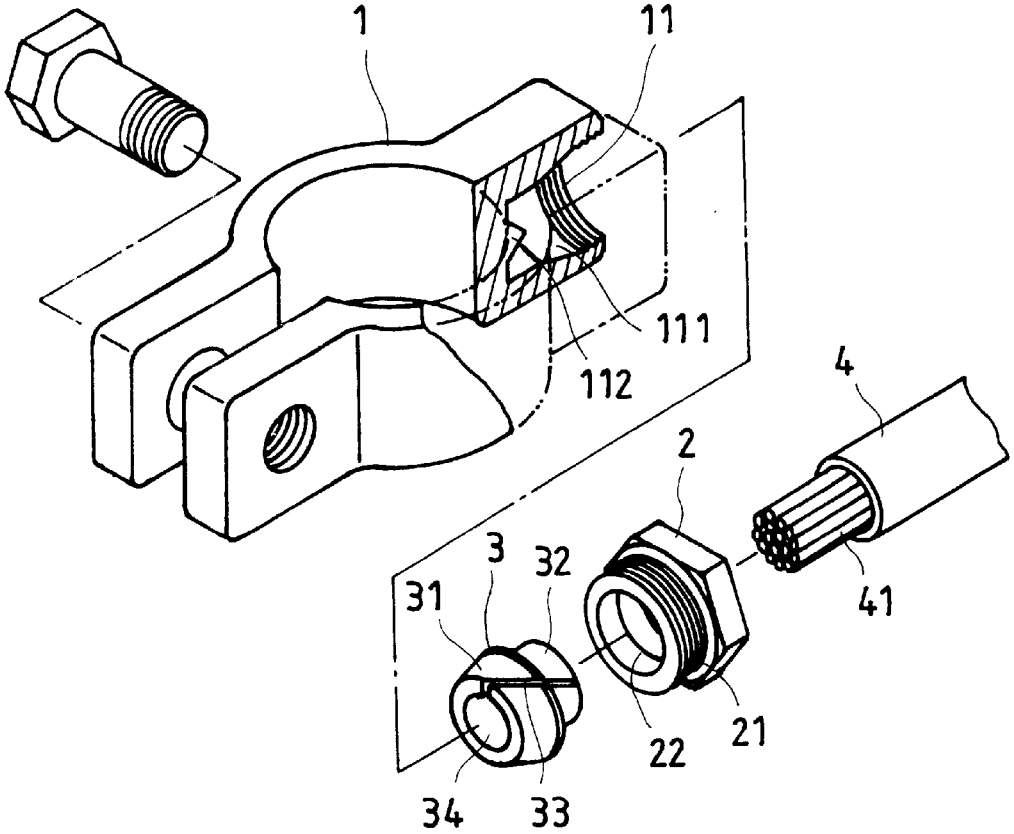
FIG. 1 is an exploded view of an electrical wire mounting structure according to a first embodiment of the present invention.
Figure 2:
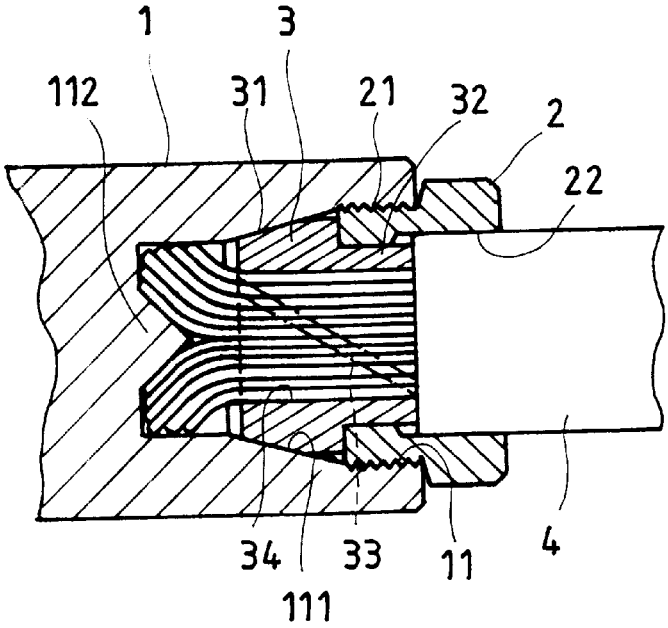
FIG. 2 is a sectional assembly view of FIG. 1.

Referring to FIGS. 1 and 2, an electrical wire mounting structure in accordance with one embodiment of the present invention comprises a metal mounting member (conductor member) 1 fastened to a storage battery (not shown) by a fastening device for example a screw, an electrical wire 4 fastened to the metal mounting member 1 by a screw member 2 and a binding member 3. The screw member 2 comprises a threaded shank 21, and a center through hole 22 axially extended through the threaded shank 21. The metal mounting member 1 comprises a screw hole 11 at its one end, a tapered blind hole 111 axially inwardly extended from the screw hole 11, and a conical projection 112 axially disposed at an inner end of the tapered blind hole 111 remote from the screw hole 11. The binding member 3 comprises a tapered base 31, a cylindrical coupling portion 32 axially extended from the tapered base 31 at one side, a center through hole 34 axially extended through the tapered base 31 and the cylindrical coupling portion 32, and a split 33 obliquely formed at the tapered base 31. The electrical wire 4 is inserted through the center through hole 22 of the screw member 2, then the conductors 41 of the electrical wire 4 are inserted through the center through hole 34 at the binding member 3, and then the cylindrical coupling portion 32 of the binding member 3 is fitted into the center through hole 22 of the screw member 2, permitting the tapered base 31 of the binding member 3 to be stopped outside the threaded shank 21 of the screw member 2, and then the threaded shank 21 of the screw member 2 is threaded into the screw hole 11 at the metal mounting member 1. When the threaded shank 21 of the screw member 2 is threaded into the screw hole 11 at the metal mounting member 1, the binding member 3 is press-fitted into the tapered blind hole 111 in the metal mounting member 1 and inwardly compressed to close the split 33 and to hold down the conductors 41, and at the same time the conical projection 112 is axially inserted into a gap in the conductors 41 to spread the conductors 41 radially outwards, and to let the conductors be firmly retained between the periphery of the conical projection 112 and the peripheral wall of the tapered blind hole 111 in the metal mounting member 1, and therefore the electrical wire 4 is firmly secured in place and positively retained in contact with the metal mounting member 1.

Figure 3:
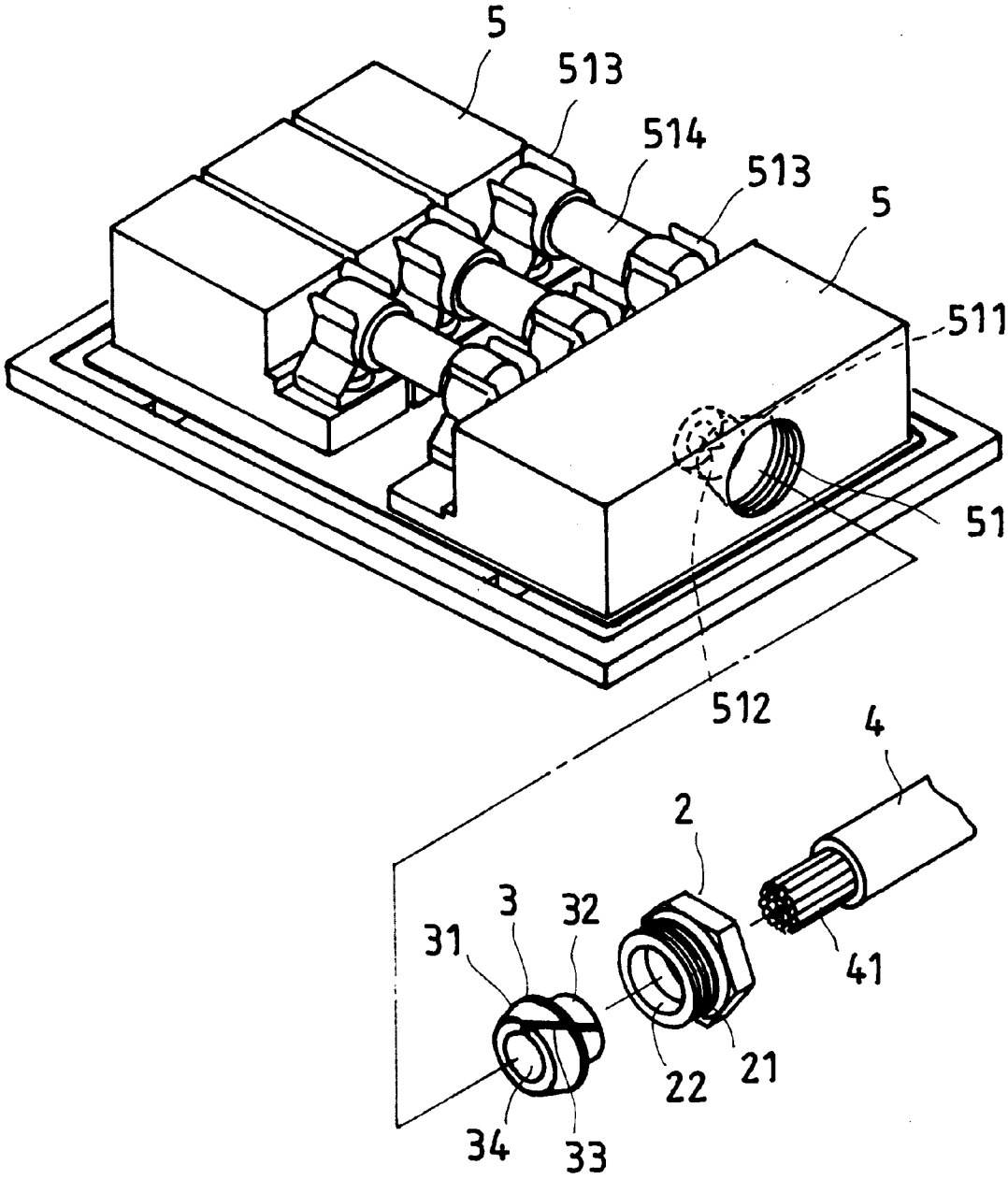
FIG. 3 shows an application example of the first embodiment of the present invention in a fuse box.
Figure 4:
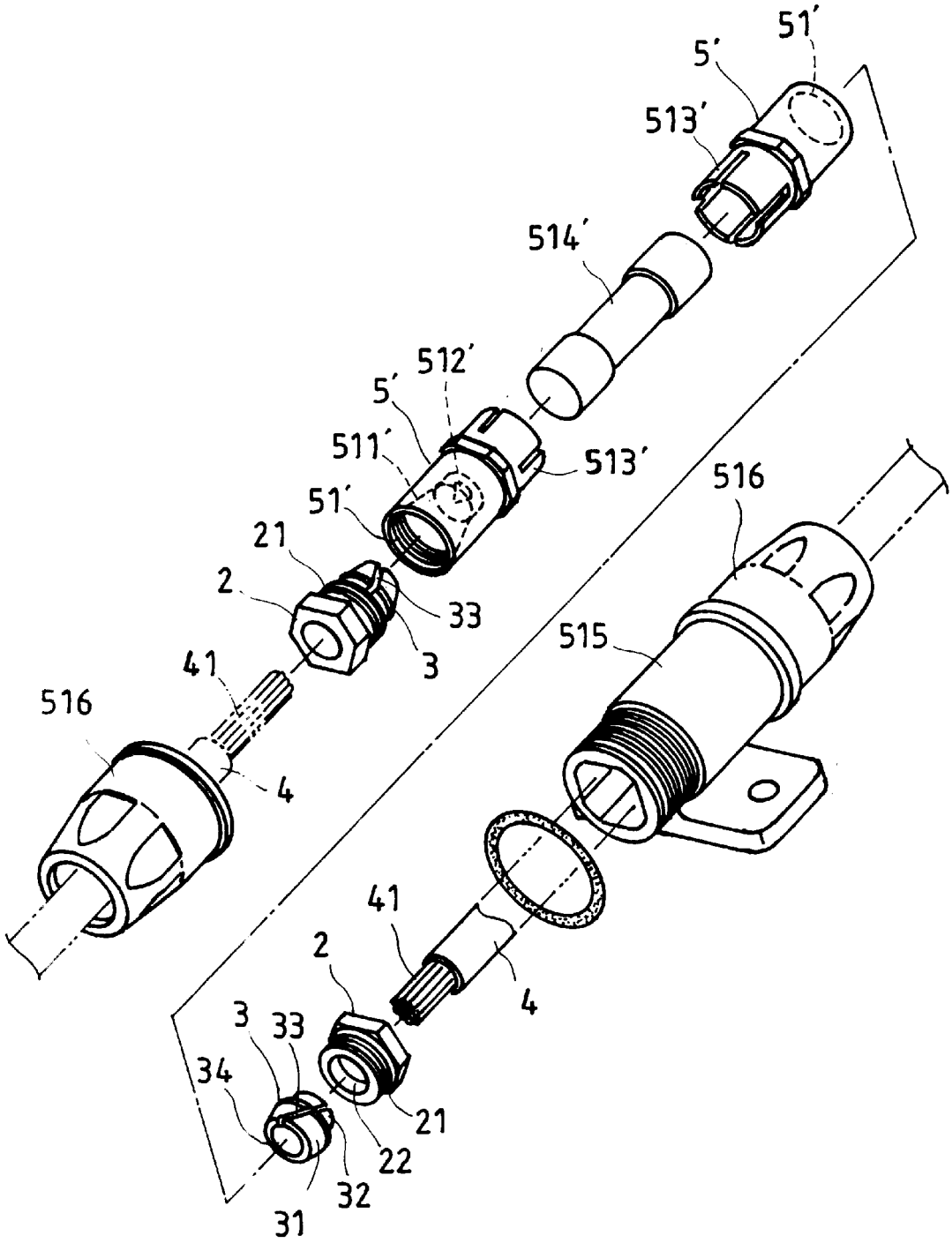
FIG. 4 shows another application example of the first embodiment of the present invention.

FIGS. 3 and 4 show an alternate form of the present invention used in a fuse box. The fuse box comprises a plurality of metal blocks 5, a plurality of cartridge fuses 514 respectively connected between fuse holders 513 at the metal blocks 5. The metal blocks 5 each comprise a screw hole 51 and a tapered blind hole 511 axially aligned, and a conical projection 512 axially disposed at an inner end of the tapered blind hole 511 remote from the screw hole 51. An electrical wire 4 is shown for connection to on metal block 5 by a screw member 2 and a binding member 3. When installed, the binding member 3 is fitted into the tapered blind hole 511 to hold down the conductors 41 of the electrical wire 4, the threaded shank 21 of the screw member 2 is threaded into the screw hole 51 to secure the finding member 3 to the metal block 5, and the electrical wire 4 is firmly retained between the periphery of the conical projection 512 and the peripheral wall of the tapered blind hole 511.

FIG. 4 shows another alternate form of the present invention. According to this alternate form, two end caps 516 are fastened to two opposite ends of a cylindrical shell 515 to hold two fuse holders 5' in the cylindrical shell 515 and a cartridge fuse 514' between the fuse holders 5', and two electrical wires 4 are respectively inserted through the end caps 516 and connected to the fuse holders 5', two binding members 3 are respectively fastened to the fuse holders 5' to hold down the electrical wires 4, and two screw members 2 are respectively fastened to the fuse holders 5' to secure the binding members 3 to the fuse holders 5'. The fuse holders 5' each comprise a screw hole 51' and a tapered blind hole 511' axially connected in a line at one side, a conical projection 512' axially disposed at one end of the tapered blind hole 511' remote from the screw hole 51', and a split clamping tube 513' at an opposite side. The positive and negative terminals of the cartridge fuse 514' are respectively fastened to the split clamping tubes 513' of the fuse holders 5'. The threaded shank 21 of each of the screw members 2 is respectively threaded into the screw hole 51' at each of the fuse holders 5'. The cylindrical coupling portion 32 of each of the binding members 3 is respectively fitted into the center through hole 22 at each of the screw members 2, and the tapered base 31 of each of the binding members 3 is respectively fitted into the tapered blind hole 511' at each of the fuse holders 5'. The electrical wires 4 are respectively inserted through the center through hole 22 at each of the screw members 2 and the center through hole 34 at each of the binding members 3, and the conductors 41 of each of the electrical wires 4 are retained between the periphery of the conical projection 512' at each of the fuse holders 5' and the peripheral wall of the tapered hole 511' at each of the fuse holders 5'.

Figure 5:
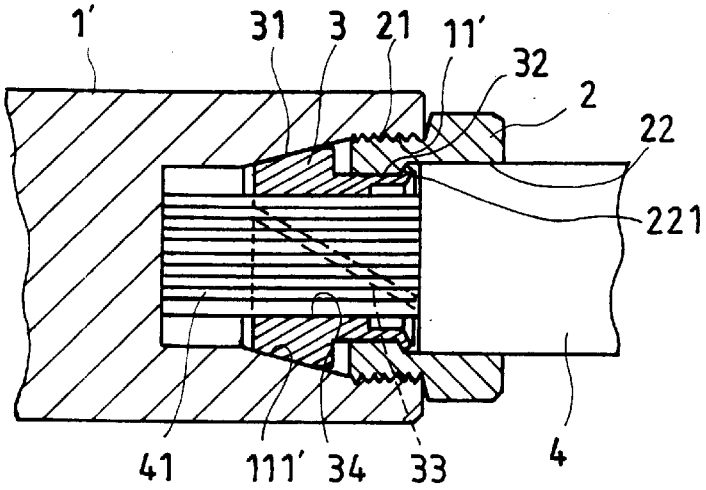
FIG. 5 is a sectional assembly view of a second embodiment of the present invention.

FIG. 5 shows still another alternate form of the present invention. According to this alternate form, an electrical wire 4 is connected to a conductor terminal 1', and secured in place by a binding member 3 and a screw member 2. The conductor terminal 1' comprises a screw hole 11' at its one side, and a tapered blind hole 111' axially inwardly extended from the screw hole 11'. The binding member 3 is fitted into the tapered blind hole 111' to hold down the conductors 41 of the electrical wire 4. The screw member 2 comprises a threaded shank 21 threaded into the screw hole 11' to secure the binding member 3 in place, a center through hole 22 through its axial center, and a beveled retaining inside wall portion 221 around the center through hole 22. The binding member 3 comprises a tapered base 31 fitted into the tapered blind hole 111' in the conductor terminal 1', a cylindrical coupling portion 32 axially extended from the tapered base 31 at one side and fitted into the center through hole 22 at the screw member 2, a center through hole 34 axially extended through the tapered base 31 and the cylindrical coupling portion 32, which receives the conductors 41 of the electrical wire 4, and a split 33 obliquely formed at the tapered base 31. After installation of the cylindrical coupling portion 32 of the binding member 3 in the center through hole 22 at the screw member 2, the peripheral edge of the cylindrical portion 32 is processed outwards and forced into engagement with the beveled retaining inside wall portion 221 inside the screw member 2.

Figure 6:
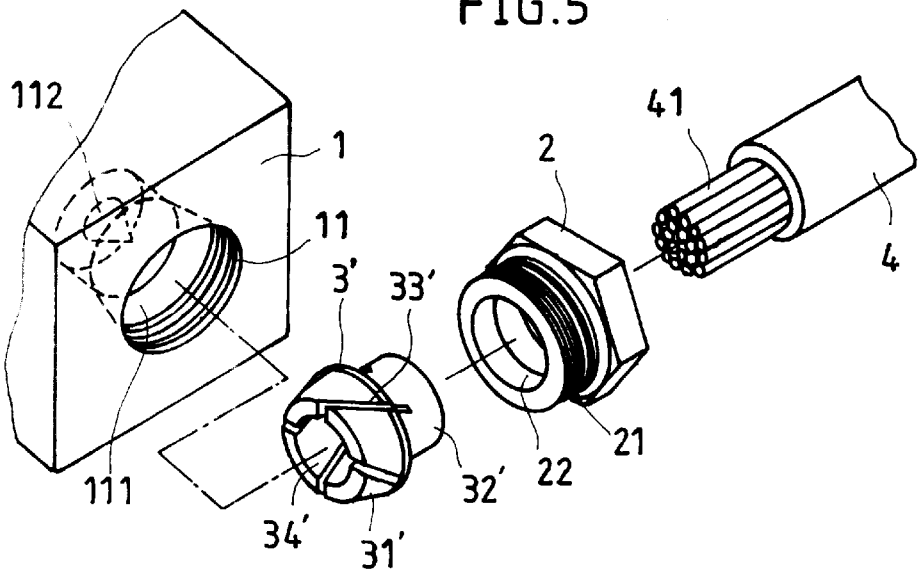
FIG. 6 is an exploded view of a third embodiment according to the present invention.
Figure 7:
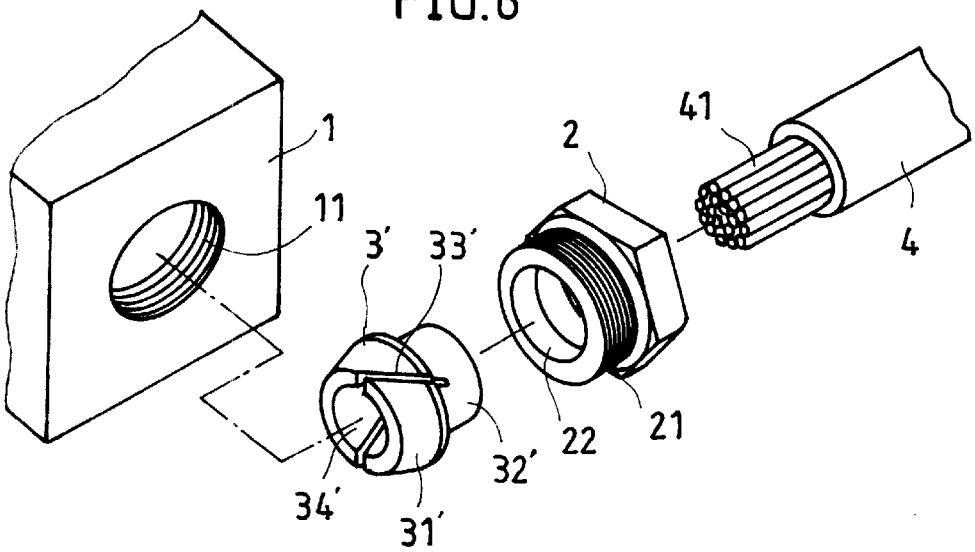
FIG. 7 is an exploded view of a fourth embodiment according to the present invention.
Figure 8:
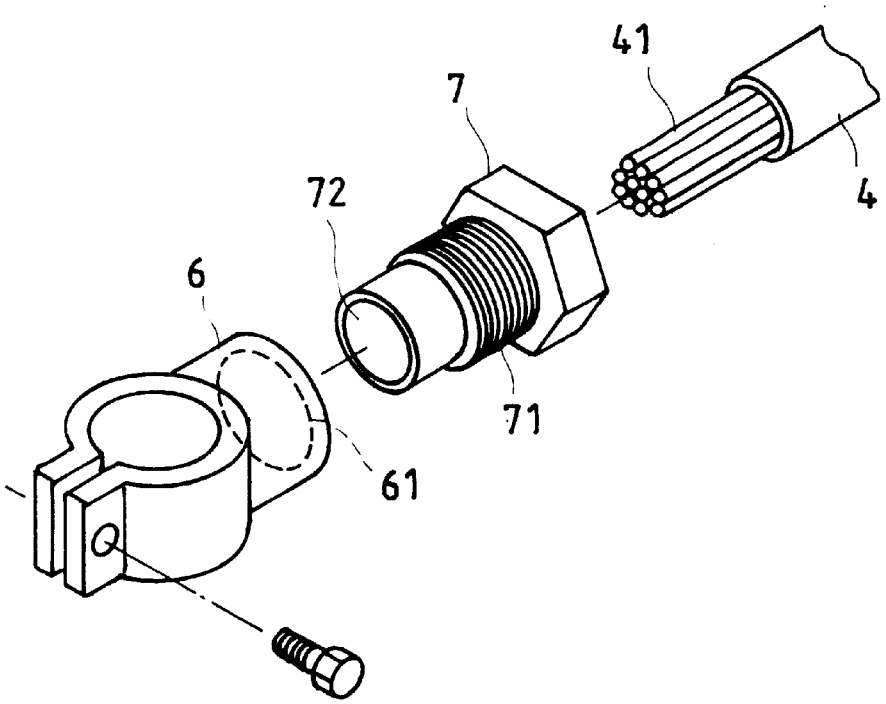
FIG.8 PRIOR ART
FIG. 8 is an exploded view of an electrical wire mounting structure according to the prior art.
Figure 9:
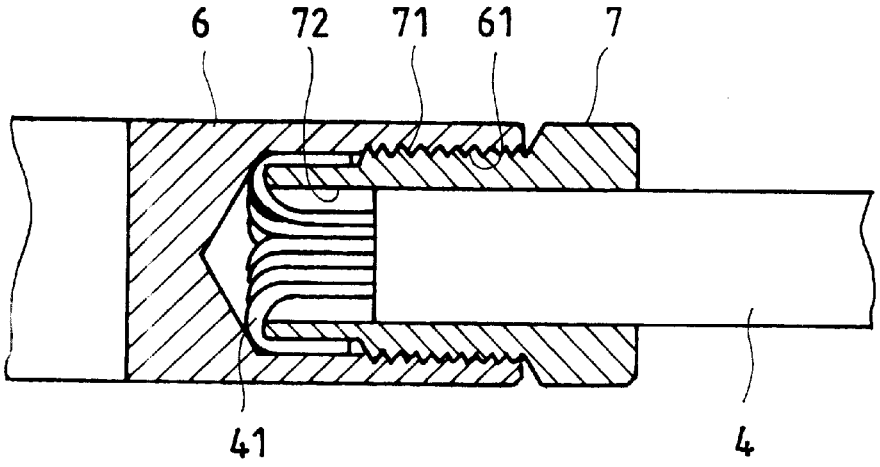
FIG.9 PRIOR ART
FIG. 9 is a sectional assembly view of FIG. 8.
Figure 10:
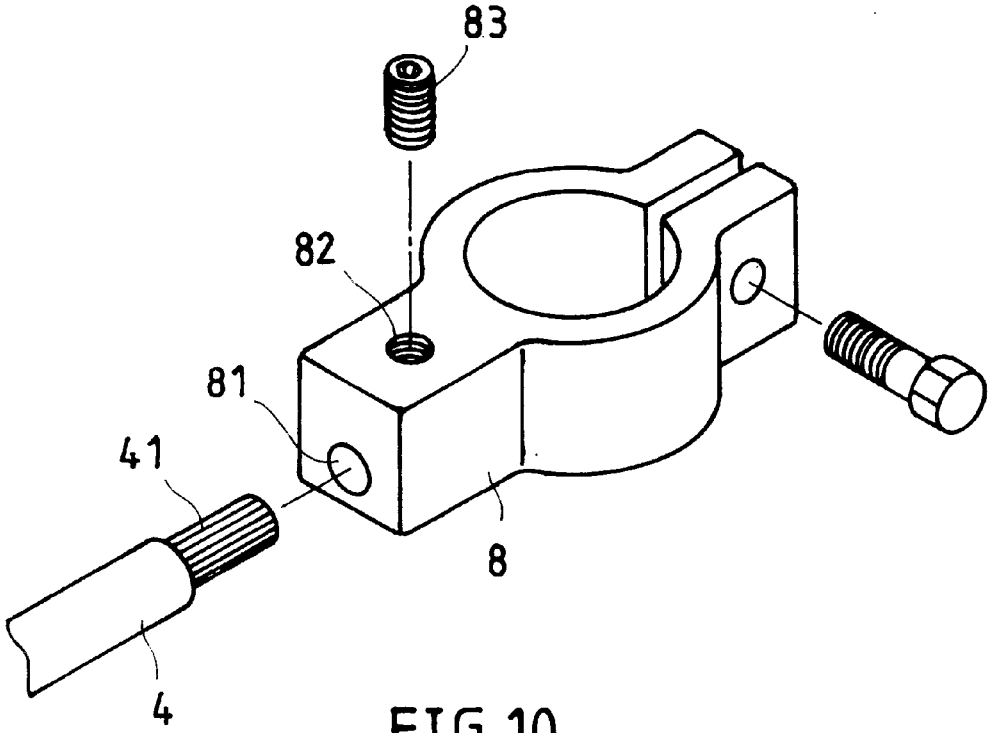
FIG.10 PRIOR ART
FIG. 10 is an exploded view of another electrical wire mounting structure according to the prior art.
Figure 11:
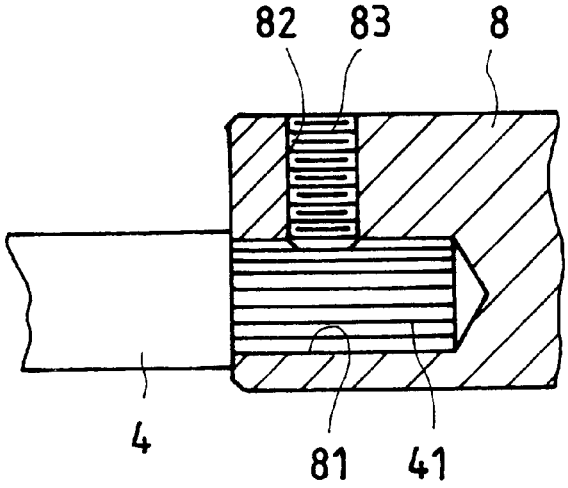
FIG.11 PRIOR ART
FIG. 11 is a sectional assembly view of FIG. 10.

FIGS. 6 and 7 shows still another alternate form of the present invention. According to this alternate form, the screw member 2 is same as the screw member shown in FIG. 1. The binding member, referenced by 3', comprises a tapered base 31' for fitting into the tapered blind hole 111 in the conductor terminal 1, a cylindrical coupling portion 32' axially extended from the tapered base 31' at one side and fitted into the center through hole 22 at the screw member 2, a center through hole 34' axially extended through the tapered base 31' and the cylindrical coupling portion 32', which receives the conductors 41 of the electrical wire 4, and a plurality of splits 33 obliquely provided around the tapered base 31'. When installed, the tapered base 31' is compressed inwards to hold down the conductors 41 of the electrical wire 4.

It is to be understood that the drawings are designed for purposes of illustration only, and arc not intended as a definition of the limits and scope of the invention disclosed.

What the invention claimed is:

1. An electrical wire mounting structure comprising:

a conductor member including a screw hole at one side thereof and a tapered blind hole axially inwardly extended from said screw hole;

an electrical wire connected to said conductor member, said electrical wire having a plurality of conductors disposed in contact with an inside wall of said conductor member;

a binding member fastened to said tapered blind hole of said conductor member to hold down said conductors of said electrical wire, said binding member including: a tapered base press-fitted into said tapered blind hole in said conductor member, a cylindrical coupling portion axially extended from said tapered base at one side, a center through hole axially extended through said tapered base and said cylindrical coupling portion for receiving said electrical wire, and at least one split obliquely formed at said tapered base; and, a screw member fastened to said conductor member to secure said binding member and said electrical wire in place, said screw member including a threaded shank threadedly engaging said screw hole of said conductor member and a center through hole axially extended through said threaded shank for receiving said cylindrical coupling portion of said binding member and at least a portion of said electrical wire received in said binding member, said screw member having formed therein an annular retaining portion extending radially inward for retention of said binding member cylindrical coupling portion in angularly displaceable manner.

2. The electrical wire mounting structure of claim 1 wherein said binding member has a curved peripheral edge forced into engagement with said annular beveled retaining portion of said screw member.

3. The electrical wire mounting structure of claim 1 wherein said conductor member is fastened to a power terminal at an electric apparatus.

4. An electrical wire mounting structure comprising:

a conductor member including a screw hole at one side thereof and a tapered blind hole axially inwardly extended from said screw hole;

an electrical wire connected to said conductor member, said electrical wire having a plurality of conductors disposed in contact with an inside wall of said conductor member;

a screw member fastened to said conductor member, said screw member including a threaded shank threadedly engaging said screw hole of said conductor member and a center through hole axially extended through said threaded shank for receiving at least a portion of said electrical wire, and a beveled retaining inside wall portion around said center through hole of said screw member; and, a binding member fastened to said tapered blind hole of said conductor member to hold down said conductors of said electrical wire and captured by said screw member, said binding member including: a tapered base press-fitted into said tapered blind hole in said conductor member, a cylindrical coupling portion axially extended from said tapered base at one side and inserted into said center through hole of said screw member, said cylindrical coupling portion having a peripheral edge curved outward and coupled to said beveled retaining inside wall portion of said screw member for enabling said binding member to be rotated with at least a portion of said electrical wire received in said screw member, a center through hole axially extended through said tapered base and said cylindrical coupling portion for receiving said electrical wire, and at least one split obliquely formed at said tapered base.

5. The electrical wire mounting structure of claim 4 wherein said conductor member comprises a conical projection axially disposed at an inner end of said tapered blind hole remote from said screw hole.

6. An electrical wire mounting structure comprising:

a conductor member including: a screw hole at one side thereof, an axially extended conical projection section, and a tapered blind hole extending axially therebetween;

an electrical wire connected to said conductor member, said electrical wire having a plurality of conductors disposed in contact with an inside wall of said conductor member;

a binding member fastened to said tapered blind hole of said conductor member to hold down said conductors of said electrical wire, said binding member including: a tapered base press-fitted into said tapered blind hole in said conductor member, a cylindrical coupling portion axially extended from said tapered base at one side, a center through hole axially extended through said tapered base and said cylindrical coupling portion for receiving said electrical wire, and at least one split obliquely formed at said tapered base; and, a screw member fastened to said conductor member to secure said binding member and said electrical wire in place, said screw member including a threaded shank threadedly engaging said screw hole of said conductor member and a center through hole axially extended through said threaded shank for receiving said cylindrical coupling portion of said binding member and at least a portion of said electrical wire received in said binding member.

* * * * *